US007204197B1

(12) United States Patent
Beauchamp et al.

(10) Patent No.: US 7,204,197 B1
(45) Date of Patent: Apr. 17, 2007

(54) MAST WAKE REDUCTION BY SHAPING

(75) Inventors: Charles H. Beauchamp, Seekonk, MA (US); James L. Dick, Saunderstown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/272,423

(22) Filed: Nov. 3, 2005

(51) Int. Cl.
*B63G 8/06* (2006.01)

(52) U.S. Cl. ..... 114/339; 114/340

(58) Field of Classification Search ..... 114/339, 114/340; 343/709, 725; 359/894
See application file for complete search history.

(56) References Cited

U.S. PATENT DOCUMENTS 1,295,355 A * 2/1919 Myers ..... 114/340
2,989,939 A 6/1961 Tatter
4,763,988 A 8/1988 Hamilton
5,279,247 A 1/1994 Plangetis
5,634,424 A 6/1997 Ortelli
5,684,493 A * 11/1997 Floyd et al. ..... 343/709
5,977,918 A 11/1999 Sirmalis
6,793,177 B2 * 9/2004 Bonutti ..... 244/78.1

FOREIGN PATENT DOCUMENTS

GB 2220390 A * 1/1990

* cited by examiner

*Primary Examiner*—Lars A. Olson
(74) *Attorney, Agent, or Firm*—James M. Kasischke; Michael P. Stanley; Jean-Paul A. Nasser

(57) ABSTRACT

A mast for use on a submarine is disclosed. The shape of the mast includes a sharp leading edge. The leading edge widens to an angle greater than the maximum angle of angle of attack that the mast will experience during maneuvering. The shape produces a stagnation zone that minimizes flow separations at the bow wave and has a pressure coefficient that approaches zero such that wake signatures of the mast are reduced. The surface of the mast is roughened to be capable of producing a turbulent boundary layer of the mast further reducing wake signatures from the bow wake.

7 Claims, 7 Drawing Sheets

MAST WAKE REDUCTION BY SHAPING

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to various mast shapes, in which the mast shapes minimize the production of visible, electro-optic, infrared and radar cross section wake signatures produced by water surface piercing masts.

(2) Background of the Invention

The contribution of submarines in littoral regions has become increasingly important as modern electronic warfare support systems proliferate. While on littoral missions, submarines invariably spend a significant time at periscope depth with one or more masts deployed through the water surface. To minimize the probability of submarine detection in the littoral regions, it is critical that mast wake signatures be minimized or eliminated. A surface piercing submarine mast typically produces signatures (i.e., spray, foam and waves) that are observable by visual, electro-optic, infrared and radar means.

One important parameter in wake signature reduction is thickness to chord ratio. Typically, the hydrodynamic loads and functional volume requirements on a submarine mast constrain the thickness to chord ratios in the range of 0.5–0.7.

Streamlining significantly reduces a visible wake by reducing bow waves and spray. Streamlining also produces lower trailing edge angles that result in reduced vortex shedding. Reduced vortex shedding minimizes generation of and mixing of bubbles and thus reduces a visible white water wake. However, the low thickness to chord ratio foils that have smaller wakes produce high lifts at angle of attack, have high wave slap loads, reduce usable internal space and take up more space in the submarine when the foils are not erected. Above 15–20° angles of attack, low thicknesses to chord foils begin to separate and thus generate more white water. Circular cross-sections minimize space requirement problems and lift and wave slap loads, but produce high drag and large wake signatures.

Alternatively, tow tank masts have ogive shapes to minimize spray and wakes and ship bows are typically sharp to minimize spray. Determining a method to incorporate the technology of tow tank masts and ship bows may be suitable to other surface piercing masts such as surface piercing masts, hydrofoil boats and oilrig platforms. Incorporating the technology will also reduce the wave heights generated by such marine vehicles and thus may allow them to travel faster through no-wake zones. As such, an improvement to masts used on submarines would be to incorporate sharp leading edges and ogive shapes as part of the shape of the masts in order to reduce the wake signatures of the masts.

SUMMARY OF THE INVENTION

It is a general purpose and object of the present invention to provide a practical approach for reducing submarine mast wakes signatures within the context of the mast functionality for both future multifunctional systems and retrofit to existing mast systems while maintaining mast structural integrity.

This object is accomplished with the present invention by providing a mast shaped with a sharp leading edge and continuing to a half angle on the leading edge greater than a maximum angle of attack that the mast will experience during maneuvering. The leading edge shape produces a stagnation zone with the effect of minimizing flow separations and has a pressure coefficient that approaches zero. As such, the leading edge shaping mitigates the production of white water as a wake signature.

One shape that meets the above criterion is ogive on the leading and trailing edges of the mast. For example: a 1 caliber ogive with no straight mid-sections results in a thickness to chord ratio of 0.5 and has leading and trailing edge half angles of approximately 53°. A noticeable advantage for total construction is the ease of fabrication of the shape since both entrance and run are constructed from two opposing arcs.

Keeping with the fluid mechanics and construction principles of the first mast shape is a first variant which extends from a pointed bottlenose leading edge to a widened central portion and onto an ogive trailing edge. A second variant of the mast shape extends from an ogive leading edge to an adjacent tapered section as a trailing edge.

A third variant of the mast shape extends from a tapered section as a leading edge with a widened portion of the tapered section adjacent to a tapered section as a trailing edge. The leading edge tapers at a greater distance from the widened portion than the trailing edge tapers from the widened section. As such, the taper is at a greater angle or more extreme for the trailing edge than for the leading edge. A fourth variant of the mast shape extends from an ogive leading edge to a widened central portion and onto a pointed bottlenose trailing edge.

A fifth variant of the mast shape has a tapered section as a leading edge with a widened portion of the tapered section adjacent to a tapered section as a trailing edge. The taper is more extreme for the leading edge than for the trailing edge. A sixth variant of the mast shape has a tapered leading edge extending to an ogive trailing edge.

The invention described herein minimizes the bow wave, ventilation cavity and aft trough in the surface around a submarine mast. This minimization will result in reduced air ingestion and bubble generation thus reducing the visible, IR, and radar wake signatures.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
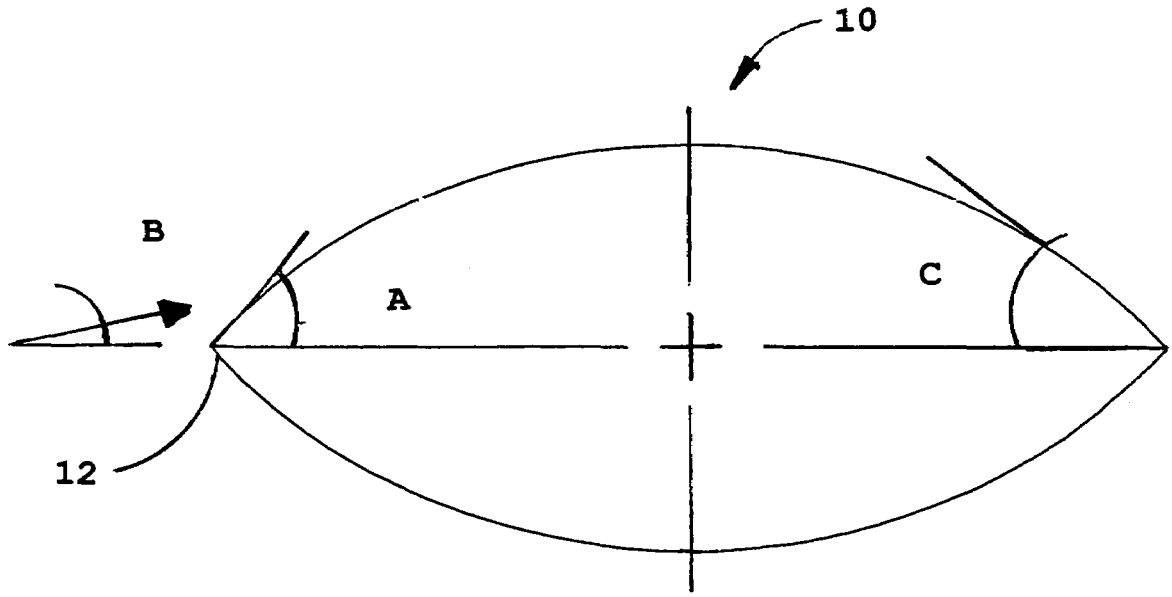
FIG. 1 depicts a mast shape of the present invention with mast wake signature reduction features.

The present invention provides a sharp leading edge on the mast and an aft shape of the mast that minimizes flow separations and has a pressure coefficient that approaches zero. The shapes presented herein (shown in FIGS. 1–7) are adaptable by those skilled in the art to construct to a specific shape for a specific mast that can be used to meet the objective of reducing wake signatures on a functional mast.

For a submarine mast, a bow wave is generated on the leading edge. A larger bow wake generates a deeper trough downstream that contributes to a deeper ventilation cavity. Both of these effects contribute to the production of white water signature. As such, the size of the bow wave is dependent on the magnitude and the lateral extent of the stagnation zone on the mast.

An effective way to reduce the bow wake is to have a sharp leading edge on the mast. However, when the mast is moving through the water at angle of attack, a sharp leading edge will separate and create a ventilation cavity that produces white water. Referring now to a mast shape 10 of FIG. 1, by making a half angle "A" on a leading edge 12 greater than a maximum angle of attack "B" (typically no greater than 30 degrees) that the mast will experience during maneuvering; the mast shape mitigates the production of white water. A small-radius circular or elliptical nose can be added to smooth the sharp leading edge 12. To minimize the bow wave the flow around the mast is analyzed with a potential flow code.

During operations, the high pressure on the forward facing surfaces produces the bow wave. When forward facing underwater surfaces have a pressure above the ambient pressure, this higher pressure forces the water and free surface upward until the increase in head balances the increase in pressure. If this higher underwater pressure were to be reduced or eliminated than so would the bow wave.

Normal force of a flow on a submerged body is well characterized for these purposes by the non-dimensional parameter, the pressure coefficient ($C_p$). The $C_p$ is defined as (Local Pressure−Ambient Pressure)/(0.5*Water Density*(Mast Velocity)^2). A $C_p$ of zero indicates no increase in pressure, a positive $C_p$ shows an increase in pressure, and a decrease in $C_p$ indicates a decrease in pressure. The $C_p$ at a location on a body where the flow has stopped is called a stagnation point. From potential or ideal flow results, the $C_p$ at stagnation is 1.0.

Ideally, if the $C_p$ at every location on a submerged mast could be zero, then the mast wake would be eliminated. However, flow about a submerged body decelerates to zero at a leading edge and then accelerates around the body. The physics of fluid mechanics compels an increase in pressure with the deceleration and an increase with acceleration. At the stagnation point the $C_p$ is one. As one moves axially aft on the mast the $C_p$ starts at one, decreases to zero, continues to decrease to a negative $C_p$ (known as $C_p$ min) and then increases once again to some value equal to or below one.

Although the leading edge will always have stagnation flow and thus a $C_p$ of 1.0, the effect on producing a bow wave would be minimized if this $C_p$ of 1.0 acted in an area as small as possible. If a $C_p$ of 1.0 acted on only an infinitesimal portion of the mast, the effect on the bow wave would be infinitesimal. Hence it is proposed that the first criteria for design is to minimize the absolute value of $C_p$ times an appropriate area to as close to zero as possible along the mast surface. Since the flow about a deeply submerged mast is primarily two dimensional, one length dimension as the area will be an assumed height of unity. The other length is defined in various ways to obtain several design parameter numbers. The appropriate area is converted to a non-dimensional area number by dividing by the wetted area of the mast (using a unit height).

Several non-dimensional area number times $C_p$ formulas are used. One is the integral of the axial component of the area times the local $C_p$ for the forward facing portion of the mast. The desire is to move this integral as close to zero as possible. For an infinitely thin plate with the flow streamwise the result would be $C_p$*Area of 1.0*0.0; for this same plate facing the flow cross-wise the result would be 1.0*1.0. A similar integral and analysis would be taken around the rearward facing mast portion. In addition, an integral is minimized of the transverse component of the area times the local $C_p$ for one side of the mast. Since the flow is symmetrical, the other side of the mast need not be considered.

The second design criteria are implemented after the completion of the first. The flow is examined for transition and possible separation. If laminar separation is found to occur, this separation can be corrected by applying roughness to the surface for tripping the flow. If laminar flow cannot be transitioned before separation or if premature turbulent flow separation occurs then the design process is started over with less a stringent minimization of the $C_p$ times area.

The shape is adjusted on the trailing edge to attempt to bring the local $C_p$ at the aft end of the mast as close to zero as possible while meeting the constraints. A $C_p$ of zero would minimize the trough in the surface aft of the mast.

After the mast shape has been designed using the potential flow analysis, boundary layer analysis is done on the shape to determine where laminar separations will occur. Laminar separation causes a ventilation cavity to form on the side of the mast. This ventilation cavity entrains air into the water column and generates a bubbly wake. To minimize this type of wake production, a roughness or another type of boundary layer trip can be formed on the surface of the mast upstream of the predicted location for laminar separation. This trips the boundary layer to turbulent and prevents separation. Selection of the boundary layer trip is also preferably based on reducing the radar cross-section of the mast shape 10. Designs for use are covered by patent disclosures, Ser. Nos. 09/685,152 and 09/685,151, incorporated herein by reference.

One shape that meets the above criterion is ogive on the leading and trailing edges of the mast. More specifically a 1 caliber ogive with no straight mid-sections results in a thickness to chord ratio of 0.5 and has leading and trailing edge half angles of approximately 53° (as shown in FIG. 1). A noticeable advantage of the shape of FIG. 1 is the ease of fabrication since both entrance and run are constructed from two opposing arcs.

The invention described here minimizes: the bow wave, ventilation cavity and aft trough in the surface also around a submarine mast. This minimization results in reduced air ingestion and bubble generation thus reducing the visible, IR, and radar wake signatures.

Alternative shapes that meet the design criteria are a pointed increased tapered nose, a pointed smaller tapered or squeegee nose, or a pressure gradient laminar flow nose shape. These various shapes (including the ogive) can be combined on leading and trailing edges, respectfully, is any combination of pairs of shapes as shown in FIGS. 2–7.

Figure 2:
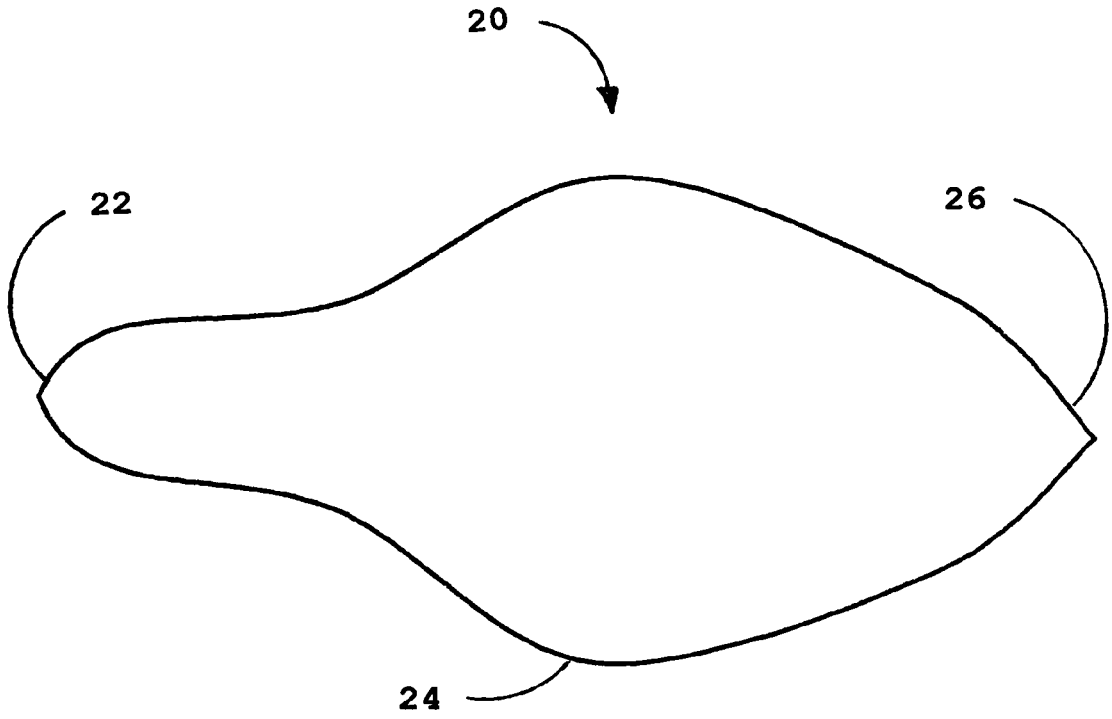
FIG. 2 depicts a first variant of the mast shape of the present invention.

FIG. 2 depicts a first variant of the present invention as a mast shape 20. The mast shape 20 extends from a pointed bottlenose leading edge 22 to a widened central portion 24 and onto an ogive trailing edge 26.

Figure 3:
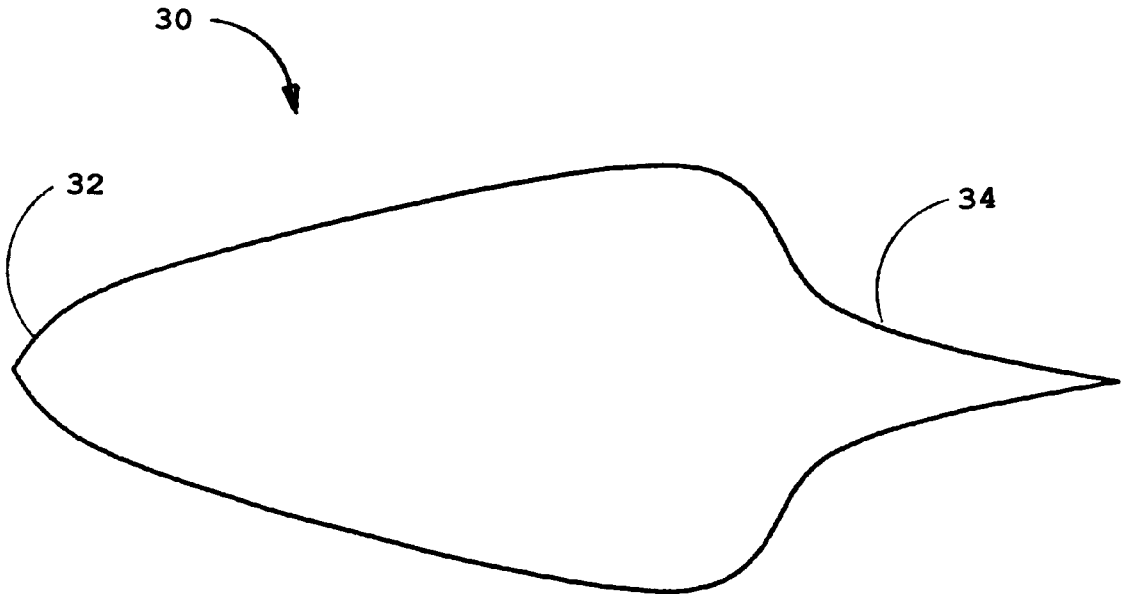
FIG. 3 depicts a second variant of the mast shape of the present invention.

FIG. 3 depicts a second variant of the present invention as a mast shape 30. The mast shape 30 extends from an ogive leading edge 32 to an adjacent tapered section 34 as a trailing edge.

Figure 4:
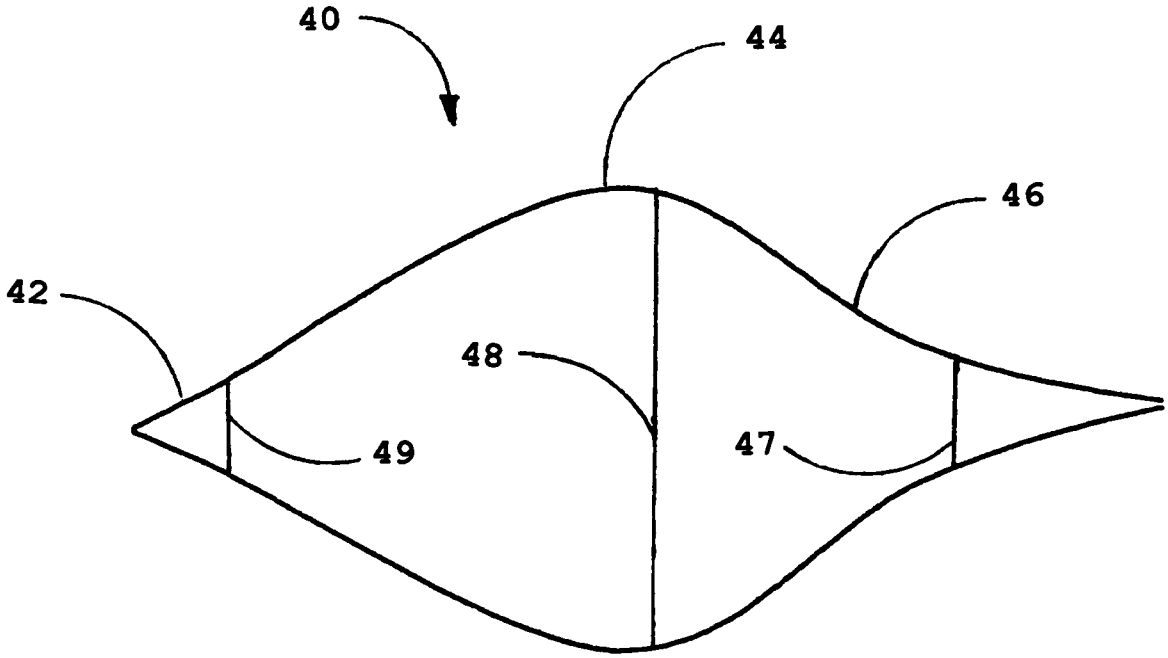
FIG. 4 depicts a third variant of the mast shape of the present invention.

FIG. 4 depicts a third variant of the present invention as a mast shape 40. The mast shape 40 extends from a tapered section 42 as a leading edge with a widened portion 44 of the tapered section adjacent to a tapered section 46 as a trailing edge. The tapered section 46 tapers to a chord 47 at a lesser distance from a chord 48 of the widened portion 44 than the tapered section 42 tapers to a chord 49 (the chord 49 equal in length to the chord 47) from the chord 48. As such, the taper is more extreme for the tapered section 46 than for the tapered section 42.

Figure 5:
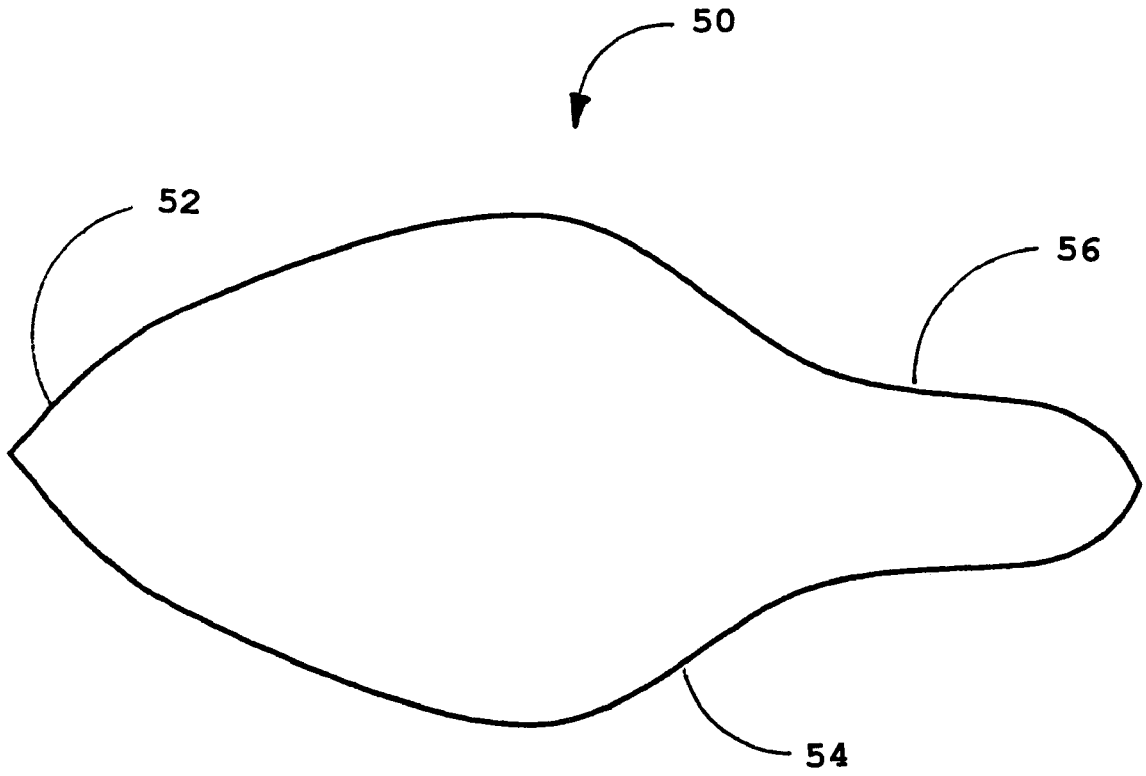
FIG. 5 depicts a fourth variant of the mast shape of the present invention.

FIG. 5 depicts a fourth variant of the present invention as mast shape 50. The mast shape 50 extends from an ogive leading edge 52 to a widened central portion 54 and onto a pointed bottlenose trailing edge 56.

Figure 6:
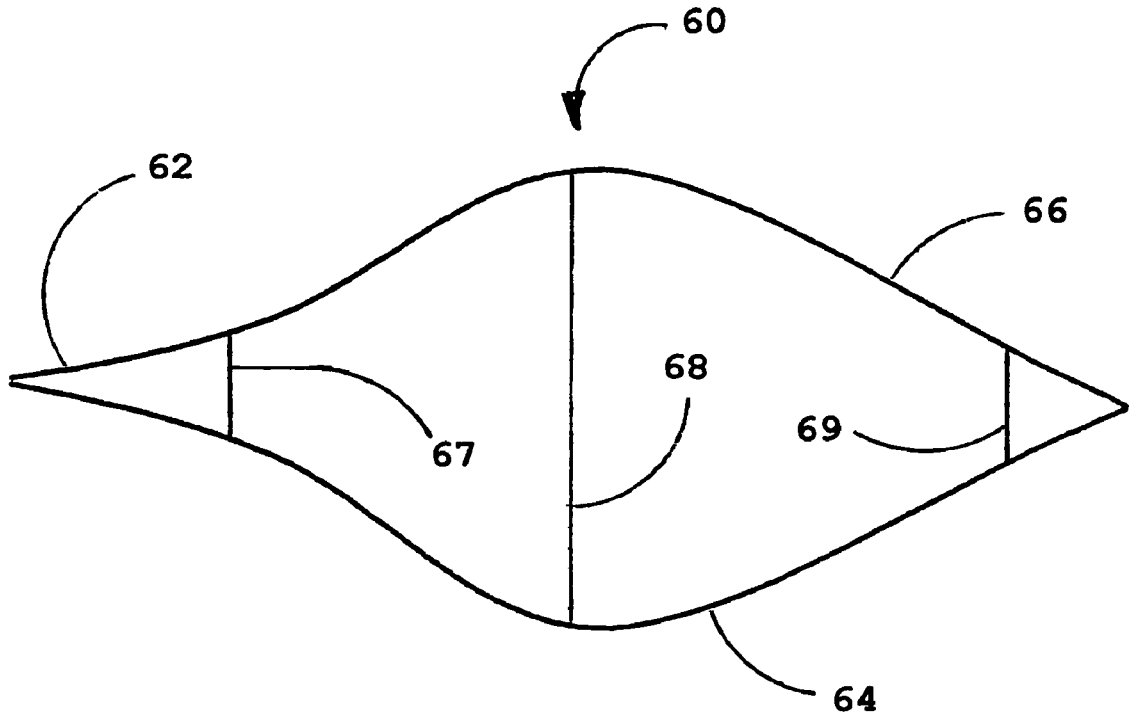
FIG. 6 depicts a fifth variant of the mast shape of the present invention.

FIG. 6 depicts a fifth variant of the present invention as mast shape 60. The mast shape 60 extends from a tapered section 62 as a leading edge with a widened portion 64 of the tapered section adjacent to a tapered section 66 as a trailing edge. The tapered section 62 tapers to a chord 67 at a lesser distance from a chord 68 of the widened portion 64 than the tapered section 66 tapers to a chord 69 (the chord 69 is equal in length to the chord 67) from the chord 68. As such, the taper is at a greater angle or more extreme for the tapered section 62 than for the tapered section 66.

Figure 7:
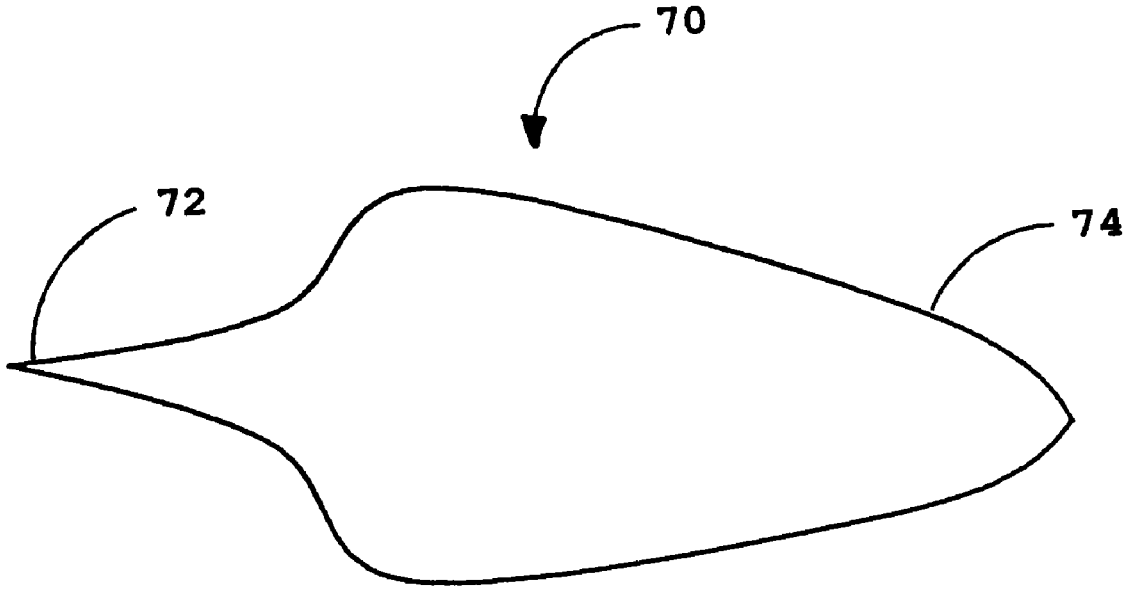
FIG. 7 depicts a sixth variant of the mast shape of the present invention.

FIG. 7 depicts a sixth variant of the present invention as mast shape 70. The mast shape 70 extends from a tapered leading edge 72 to an ogive trailing edge 74.

FIGS. 2–7 show some sample classes of shapes but this invention is not limited to the shapes shown.

While the invention has been described in connection with what is considered to be the most practical and preferred embodiments, it should be understood that this invention is not to be limited to the disclosed embodiment, but on the contrary is intended to cover various modifications and equivalent arrangements included within the spirit and scope of the appended claims.

What is claimed is:

1. A mast for reducing wake signatures, said mast comprising:

a leading edge extending as an ogive from a longitudinal axis of said mast thereby forming a stagnation zone at said leading edge; and a trailing edge conjoined to said leading edge at a central portion of said mast wherein said trailing edge is ogive from said longitudinal axis to said central portion;

wherein said leading edge extends from said longitudinal axis to said central portion as a pointed bottlenose and whereby the shape of said mast from said leading edge to said trailing edge is capable of minimizing flow separations from a bow wave generated at said stagnation zone thereby reducing resultant wake signatures.

2. The mast in accordance with claim 1 wherein said pointed bottlenose extends from said longitudinal axis at an angle greater than 30 degrees on each side of said longitudinal axis.

3. The mast in accordance with claim 2 wherein a surface of said mast is roughened thereby capable of producing a turbulent boundary layer of said mast further reducing wake signatures from the bow wave.

4. A mast for reducing wake signatures, said mast comprising:

a leading edge extending as an ogive from a longitudinal axis of said mast thereby forming a stagnation zone at said leading edge; and a trailing edge conjoined to said leading edge at a central portion of said mast wherein said trailing edge is ogive from said longitudinal axis to said central portion;

wherein said leading edge is tapered from said central portion to said longitudinal axis, and said trailing edge is tapered from said central portion to said longitudinal axis;

wherein said leading edge tapers to a first chord at a greater distance from a second chord at said central portion than said trailing edge tapering to a third chord from said second chord, said third chord equal in length to said first chord such that the taper to said leading edge is at a lesser angle than the taper for said trailing edge; and whereby the shape of said mast from said leading edge to said trailing edge is capable of minimizing flow separations from a bow wave generated at said stagnation zone thereby reducing resultant wake signatures.

5. The mast in accordance with claim 4 wherein a surface of said mast is roughened thereby capable of producing a turbulent boundary layer of said mast further reducing wake signatures from the bow wave.

6. A mast for reducing wake signatures, said mast comprising:

a leading edge extending as an ogive from a longitudinal axis of said mast thereby forming a stagnation zone at said leading edge; and a trailing edge conjoined to said leading edge at a central portion of said mast wherein said trailing edge is ogive from said longitudinal axis to said central portion;

wherein said trailing edge extends from said longitudinal axis as a pointed bottlenose to said central portion; and whereby the shape of said mast from said leading edge to said trailing edge is capable of minimizing flow separations from a bow wave generated at said stagnation zone thereby reducing resultant wake signatures.

7. The mast in accordance with claim 6 wherein a surface of said mast is roughened thereby capable of producing a turbulent boundary layer of said mast further reducing wake signatures from the bow wave.

* * * * *